US008181403B1

(12) United States Patent
Polston

(10) Patent No.: US 8,181,403 B1
(45) Date of Patent: May 22, 2012

(54) ROOF VENT

(75) Inventor: Scott Ross Polston, Houston, TX (US)

(73) Assignee: Ross Manufacturing, LLC, New Braunfels, TX (US)

( * ) Notice: Subject to any disclaimer, the term of this patent is extended or adjusted under 35 U.S.C. 154(b) by 315 days.

(21) Appl. No.: 12/625,517

(22) Filed: Nov. 24, 2009

(51) Int. Cl.
*E04B 7/00* (2006.01)

(52) U.S. Cl. ..... 52/198; 52/199

(58) Field of Classification Search ..... 52/198, 52/199, 200; 454/359
See application file for complete search history.

(56) References Cited

U.S. PATENT DOCUMENTS 3,934,383 A 1/1976 Perry et al.
6,155,008 A * 12/2000 McKee ..... 52/198
6,293,862 B1 * 9/2001 Jafine et al. ..... 454/359
6,302,787 B1 * 10/2001 Graft, Jr. ..... 454/366
6,767,281 B2 7/2004 McKee

* cited by examiner

*Primary Examiner* — Basil Katcheves
(74) *Attorney, Agent, or Firm* — Eric Karich

(57) ABSTRACT

A roof vent has a base member adapted to be mounted on a roof, and a cover member for excluding water. The base member has a generally planar base having an outer perimeter and an inner perimeter, the inner perimeter defining a vent aperture. A water barrier wall extends upwardly from the base around the vent aperture for excluding water. A ventilated dome extends from the water barrier wall at least partially over the vent aperture. Generally triangular wedges extending outwardly from the water barrier wall, shaped to direct water flow away from the water barrier wall. The cover member has a top cover element with a perimeter flange extending downwardly, and is adapted to be mounted over the base member.

3 Claims, 4 Drawing Sheets

ROOF VENT

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to roof vents, and more particularly to a roof vent that includes improved structural elements for preventing water leakage during heavy rains.

2. Description of Related Art

There are various roof vents known in the art for covering a vent opening in a roof for providing ventilation to a home or other structure.

McKee, U.S. Pat. No. 6,767,281, for example, teaches a roof vent that includes a base portion that is mounted on a roof of a structure, a vent structure for allowing venting to the structure, and a cover portion for excluding rain. Another example is shown in Perry et al., U.S. Pat. No. 3,934,383, which teaches another roof vent of generally similar construction. The above-described references are hereby incorporated by reference in full.

Despite the construction of the roof vents to exclude rain and the like, prior art vents can still leak, especially when rain is particularly heavy and/or driving. New features are needed to block or redirect water flows away from the roof vent, to help prevent leakage.

The prior art teaches roof vents that are adapted to allow ventilation but exclude rain. However, the prior art does not teach a roof vent with improved features that block or redirect water flows away from the roof vent, to help prevent leakage. The present invention fulfills these needs and provides further related advantages as described in the following summary.

SUMMARY OF THE INVENTION

The present invention teaches certain benefits in construction and use which give rise to the objectives described below.

The present invention provides a roof vent adapted to be mounted on a roof to cover a vent opening. The roof vent includes a base member for mounting on the roof, and a cover member for excluding rain. The base member has a generally planar base having an outer perimeter and an inner perimeter, the inner perimeter defining a vent aperture. A water barrier wall extends upwardly from the base around the vent aperture for excluding water. A ventilated dome extends from the water barrier wall at least partially over the vent aperture. Generally triangular wedges extending outwardly from the water barrier wall, shaped to direct water flow away from the water barrier wall. The cover member has a top cover element with a perimeter flange extending downwardly from the top cover element. A fastening construction fastens the cover member onto the base member such that the cover member covers the ventilated dome of the base member.

A primary objective of the present invention is to provide a roof vent having advantages not taught by the prior art.

Another objective is to provide a roof vent that includes generally triangular shaped wedges extending from the water barrier wall to direct water away from the water barrier wall.

Another objective is to provide a roof vent that includes a fastening wall extending laterally above the water barrier wall.

A further objective is to provide a roof vent that includes a concave wall extending laterally below the water barrier wall.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a roof vent 10 adapted to be mounted on a roof 12 to cover a vent opening 14.

Figure 1:
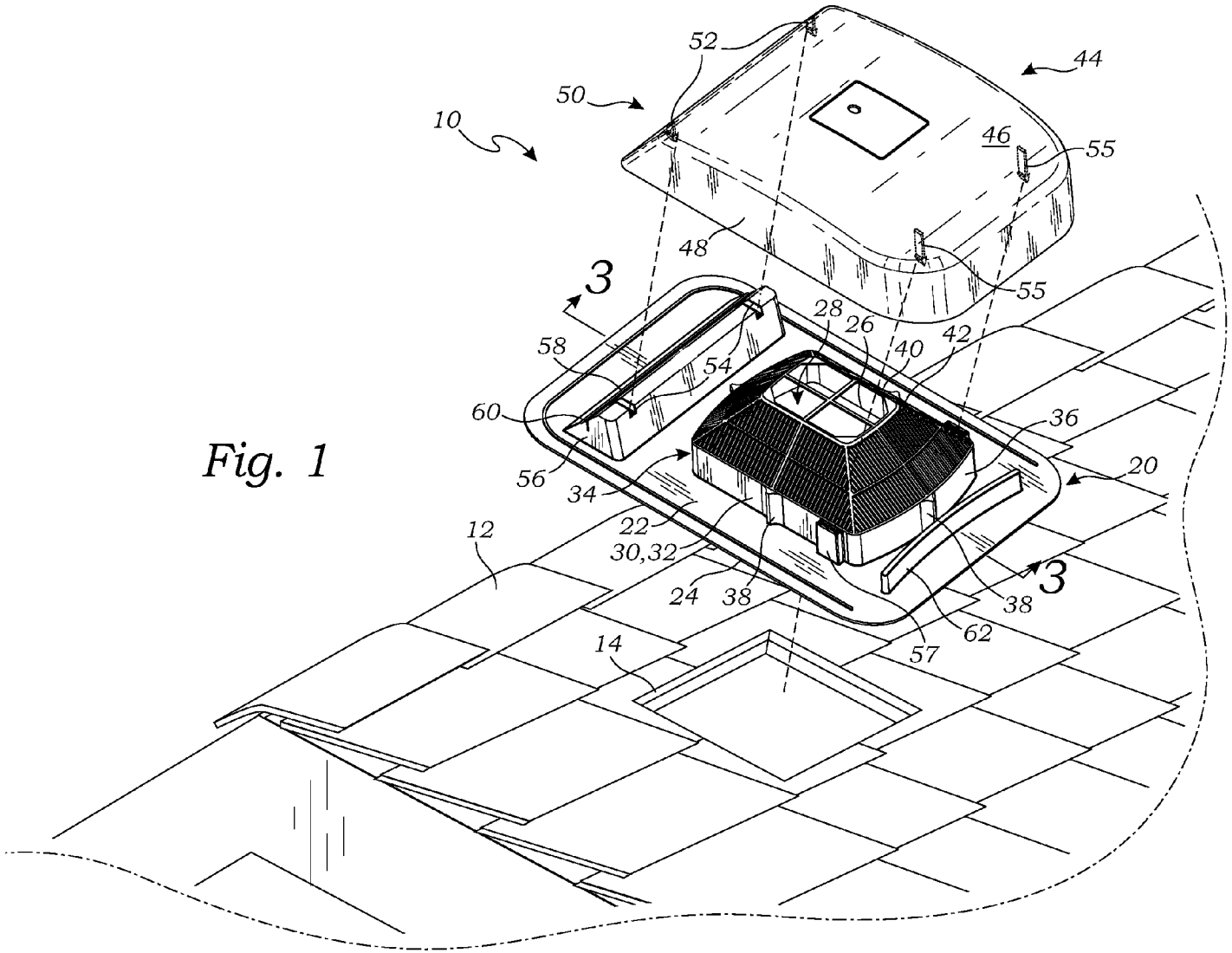
FIG. 1 is an exploded perspective view of a roof vent according to one embodiment of the present invention, the roof vent having a base member and a cover member, the roof vent being positioned on a roof to cover a vent opening.

FIG. 1 is an exploded perspective view of a roof vent 10 according to one embodiment of the present invention. As illustrated in FIG. 1, the roof vent 10 includes a base member 20 and a cover member 44. As discussed in greater detail below, the base member 20 is adapted to be mounted on the roof 12 over the vent opening 14. The base member 20 is installed on the roof 12 using techniques and materials well known in the art. The cover member 44 is mounted on the base member 20 to cover the vent opening 14 and prevent water from leaking into the vent opening 14.

Figure 2:
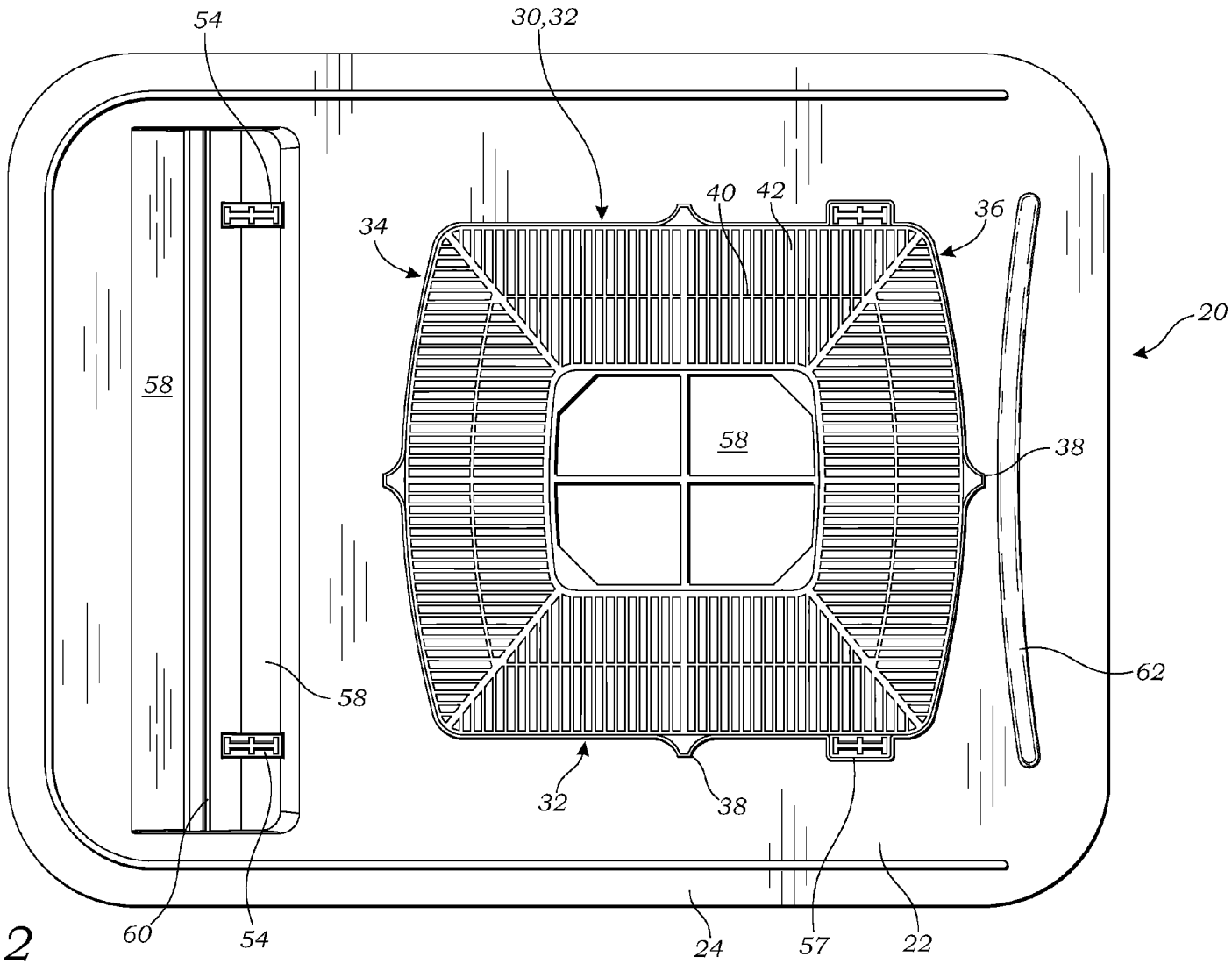
FIG. 2 is a top plan view of the base member of the roof vent.
Figure 3:
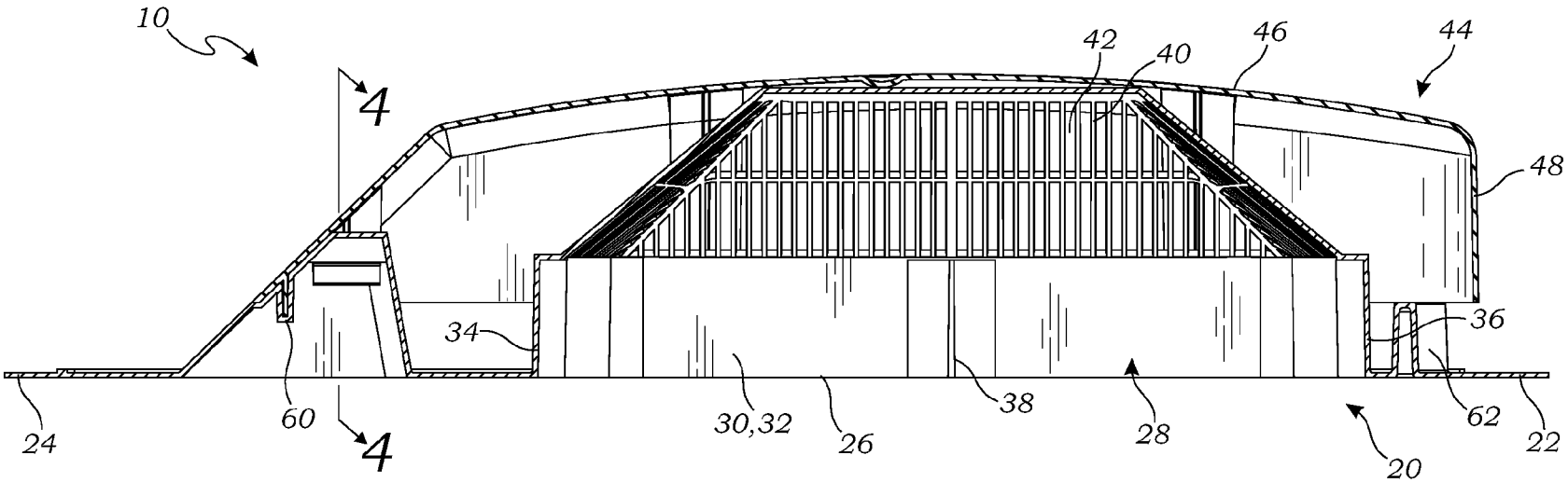
FIG. 3 is a sectional view of the roof vent taken along line 3-3 in FIG. 1.

FIG. 2 is a top plan view of the base member 20 of the roof vent 10. FIG. 3 is a sectional view of the roof vent 10 taken along line 3-3 in FIG. 1. As shown in FIGS. 1-3, the base member 20 includes a generally planar base 22 having an outer perimeter 24 and an inner perimeter 26. The inner perimeter 26 defines a vent aperture 28. In use, the base member 20 is adapted to be fastened to the roof 12 such that the vent aperture 28 is in fluid communication with the vent opening 14 of the roof 12. For purposes of this application, the term "generally planar base 22" is defined broadly to include any generally planar sheet such as is well known in the art, and further any other shape or configuration that is suitable to be installed on the roof 12 as described herein, whether or not said configuration is actually planar in a strictly geometric sense.

A water barrier wall 30 extends upwardly from the generally planar base 22 around the vent aperture 28. In the embodiment of FIGS. 1-3, the water barrier wall 30 is a generally rectangular wall having a pair of opposing side walls 32 connected together with a top wall 34 and a bottom wall 36. In alternative embodiments, the water barrier wall 30 may be of other shape (e.g., round, oval, octagonal, etc.) which function to exclude water running over the generally planar base 22 from the vent aperture 28.

In one embodiment, the water barrier wall 30 includes generally triangular wedges 38 shaped to direct water flow away from the water barrier wall 30. For purposes of this application, the term "generally triangular wedges" is hereby defined to include triangular or similar protruding members that function to direct water flow away from the water barrier wall 30. The wedges may be centrally positioned and extend vertically the height of the water barrier wall 30, or alternatively may be located elsewhere, and extend to different heights, as long as they function to direct water flow away from the water barrier wall 30. In redirecting the water flow in this manner, leakage is avoided during heavy rains that might otherwise spill over the water barrier wall 30.

In the embodiment of FIGS. 1-3, one of the generally triangular wedges 38 extends outwardly from each of the pair of opposing side walls 32 of the generally rectangular water barrier wall 30, and may further extend from each of the top and bottom walls 34 and 36 of the water barrier wall 30 to protect against lateral water flows induced by wind or other forces.

A ventilated dome 40 extends from the water barrier wall 30 at least partially over the vent aperture 28. The ventilated dome 40 includes apertures 42 (e.g., holes, slots, or the like) so that air may circulate therethrough, while excluding small animals, debris, and similar intrusions. In this manner, air may flow through the base member 20 and through the roof 12 for ventilation.

As illustrated in FIGS. 1 and 3, the roof vent 10 further includes a cover member 44 for covering the base member 20 and preventing rain from entering the vent aperture 28. The cover member 44 may include a top cover element 46, and may further include a perimeter flange 48 extending downwardly from the top cover element 46. The general construction of the cover member 44 is well known in the art, and is therefore not described in greater detail herein.

Figure 4:
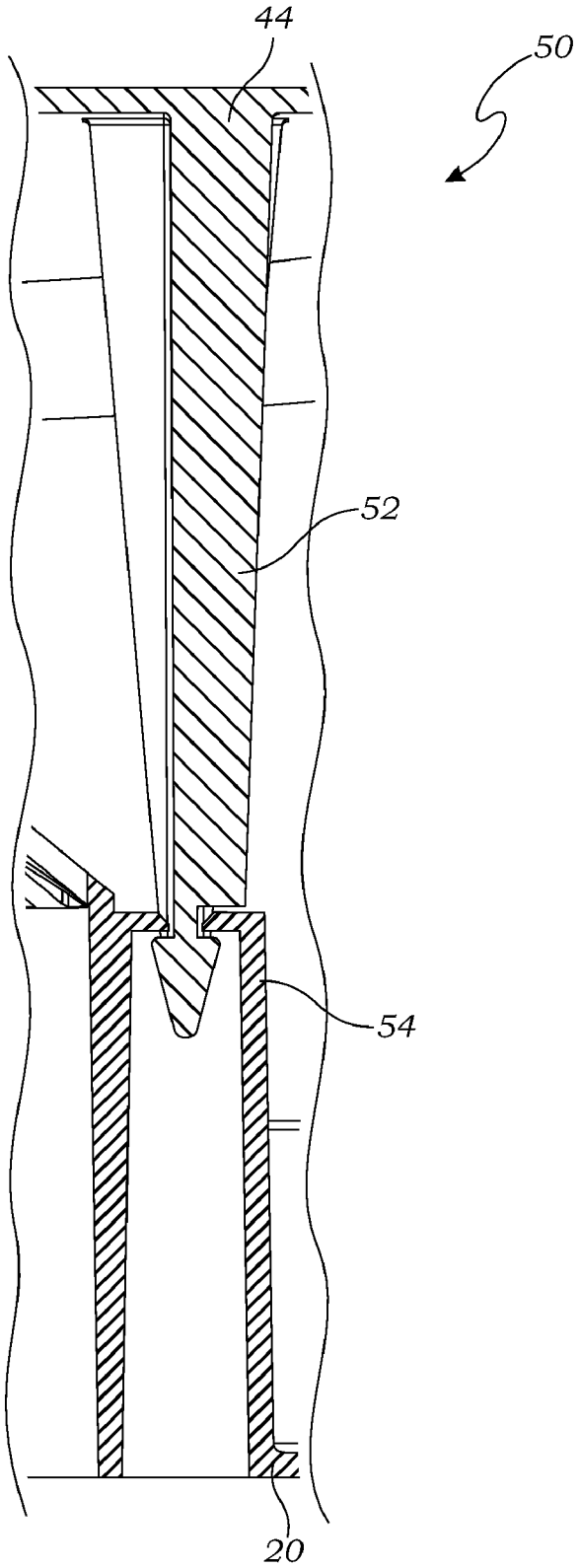
FIG. 4 is a sectional view of a fastening construction of the roof vent, the view being taken along lines 4-4 in FIG. 3.

The roof vent 10 further includes a fastening construction 50 for fastening the cover member 44 onto the base member 20 such that the cover member 44 covers the ventilated dome 40 of the base member 20. Those skilled in the art may devise many alternative structures known in the art for fastening the cover member 44 onto the base member. In one embodiment, illustrated in FIG. 4, the fastening construction 50 includes a pair of hook elements 52 extending from the cover member 44, and a pair of receivers 54 of the base member 20. Each of the pair of hook elements 52 is adapted to lockingly engage one of the pair of receivers 54.

Additional locking features 55 and other receivers 57 may be located elsewhere on the base member 20 for greater structural stability. Furthermore, the fastening construction 50 may include alternative constructions used in the art of fastening that are suitable for this purpose, and such alternatives should be considered within the scope of the present invention.

In one embodiment, illustrated in FIGS. 1-4, the base member 20 further includes a fastening wall 56 extending upwardly from the generally planar base 22 adjacent the top wall 34 of the water barrier wall 30. In one embodiment, the fastening wall 56 extends laterally, preferably further than the top wall 34, to direct water away from the vent aperture 28. The fastening wall 56 may include an angled top surface 58 opposite the top wall 34 of the water barrier wall 30. The angled top surface 58 may include a slot 60 for receiving the cover element 46, to better exclude water from the vent aperture 28. The fastening wall 56 may further include the pair of receivers 54 adapted for mounting the cover member 44 onto the base member 20.

In one embodiment, the roof vent 10 may further include a concave wall 62 extending upwardly from the generally planar base 22 adjacent the bottom wall 36 of the water barrier wall 30, opposite the fastening wall 56. In a similar manner to the fastening wall 56, the concave wall 62 may extending laterally approximately as far as the bottom wall 36 (more or less, as required by the user). The concave wall 62 prevents water from entering the vent aperture 28 from beneath the roof vent 10, when blown upwardly by wind or other forces. The concave wall 62 includes a concave curvature to enable water to escape from the concave wall 62 and not be trapped and pooled on the roof vent 10.

The terminology used in the specification provided above is hereby defined to include similar and/or equivalent terms, and/or alternative embodiments that would be considered obvious to one skilled in the art given the teachings of the present patent application. Additionally, the words "a," "an," and "one" are defined to include one or more of the referenced item unless specifically stated otherwise. Also, the terms "have," "include," "contain," and similar terms are defined to mean "comprising" unless specifically stated otherwise.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A roof vent adapted to be mounted on a roof to cover a vent opening, the roof vent comprising:

a base member having a generally planar base having an outer perimeter and an inner perimeter, the inner perimeter defining a vent aperture, the base member being adapted to be fastened to the roof such that the vent aperture is in fluid communication with the vent opening of the roof;

a water barrier wall extending upwardly from the generally planar base around the vent aperture, the water barrier wall having a pair of opposing side walls connected together with a top wall and a bottom wall;

a ventilated dome extending from the water barrier wall at least partially over the vent aperture; and a pair of generally triangular wedges, each of the generally triangular wedges extending outwardly from one of the pair of opposing side walls shaped to direct water flow away from the water barrier wall; and a cover member adapted to be mounted on the base member, the cover member having a top cover element with a perimeter flange extending downwardly from the top cover element.

2. A roof vent adapted to be mounted on a roof to cover a vent opening, the roof vent comprising:

a base member having a generally planar base having an outer perimeter and an inner perimeter, the inner perimeter defining a vent aperture, the base member being adapted to be fastened to the roof such that the vent aperture is in fluid communication with the vent opening of the roof;

a water barrier wall extending upwardly from the generally planar base around the vent aperture;

a ventilated dome extending from the water barrier wall at least partially over the vent aperture; and wedges extending outwardly from the water barrier wall shaped to direct water flow away from the water barrier wall;

a cover member having a top cover element with a perimeter flange extending downwardly from the top cover element; and a fastening construction for fastening the cover member onto the base member such that the cover member covers the ventilated dome of the base member, the fastening construction including:

a fastening wall extending upwardly from the generally planar base adjacent the top wall of the water barrier wall, the fastening wall having an angled top surface that includes a slot shaped to receive the cover element to exclude water from the vent aperture;

a pair of hook elements extending from the cover member; and a pair of receivers of the fastening wall, each of the pair of hook elements being adapted to lockingly engage one of the pair of receivers.

3. A roof vent adapted to be mounted on a roof to cover a vent opening, the roof vent comprising:

a base member having a generally planar base having an outer perimeter and an inner perimeter, the inner perimeter defining a vent aperture, the base member being adapted to be fastened to the roof such that the vent aperture is in fluid communication with the vent opening of the roof;

a water barrier wall extending upwardly from the generally planar base around the vent aperture;

a ventilated dome extending from the water barrier wall at least partially over the vent aperture; and wedges extending outwardly from the water barrier wall shaped to direct water flow away from the water barrier wall;

a cover member having a top cover element with a perimeter flange extending downwardly from the top cover element;

a pair of hook elements extending from the cover member;

a fastening wall extending upwardly from the generally planar base, the fastening wall extending laterally adjacent the water barrier wall; and a pair of receivers formed in the fastening wall of the base member, each of the pair of hook elements being adapted to lockingly engage one of the pair of receivers.

* * * * *